United States Patent [19]

Leckie et al.

[11] 4,056,657

[45] Nov. 1, 1977

[54] ZINC-ALUMINUM EUTECTIC ALLOY COATED FERROUS STRIP

[75] Inventors: Harry P. Leckie, Schererville; William C. Sievert, Chesterton, both of Ind.; Robert A. Legault, Homewood, Ill.

[73] Assignee: Inland Steel Company, Chicago, Ill.

[21] Appl. No.: 694,773

[22] Filed: June 10, 1976

Related U.S. Application Data

[63] Continuation-in-part of Ser. No. 596,427, July 16, 1975, abandoned.

[51] Int. Cl.[2] ..... B32B 15/18

[52] U.S. Cl. ..... 428/659; 427/433

[58] Field of Search ..... 29/196.2, 196.5; 427/433; 428/609

[56] References Cited

U.S. PATENT DOCUMENTS

| | | | |
|---|---|---|---|
| 1,741,388 | 9/1926 | Wehr et al. | 427/311 |
| 2,824,021 | 2/1958 | Cook et al. | 427/433 |
| 3,056,694 | 10/1962 | Mehler et al. | 427/433 |
| 3,320,040 | 5/1967 | Roe et al. | 29/196.5 |
| 3,505,043 | 4/1970 | Lee et al. | 29/196.5 |
| 3,962,501 | 6/1976 | Ohbu et al. | 427/433 |

FOREIGN PATENT DOCUMENTS

| | | | |
|---|---|---|---|
| 2,146,376 | 3/1972 | Germany | 427/433 |

OTHER PUBLICATIONS

"The Effect of Impurities on the Oxidation and Swelling of Zn-Al Alloys", Trans AIME, vol. 68, p. 796; 1923.

"The Effects of Agitation, Cooling and Al on the Alloying in Hot Dipping in Zn", Cameron; Edited Proc. 6th Int'l Conf. on Hot-Dip Galvanizing, Interlaken, pp. 276-311; 6/71.

*Primary Examiner*—Arthur J. Steiner

*Attorney, Agent, or Firm*—Hibben, Noyes & Bicknell

[57] ABSTRACT

A ferrous metal strip having a continuous hot-dip coating consisting essentially of the zinc-5% aluminum eutectic alloy which contains as the only metallic additive a metal which reduces the surface tension of the coated bath, such as lead, antimony or tin, with the total amount of the metallic additives being a maximum of about 0.1 wt. %, and said coating being formable and exhibiting good corrosion resistance when exposed to marine-type environments and having a bright, smooth surface free of ripples and spangles which interfere with paintability and weldability.

4 Claims, No Drawings

ZINC-ALUMINUM EUTECTIC ALLOY COATED FERROUS STRIP

This is a continuation-in-part of application Ser. No. 596,427, filed on July 16, 1975, and now abandoned.

The present invention relates generally to providing an improved zinc-based allow hot-dip coated ferrous metal article and more particularly to the improve zinc-aluminum alloy continuous heat-treat in-line hot-dip coated ferrous metal strip.

Zinc based coatings have long been applied to a ferrous metal strip by the hot-dip coating process in order to protect the ferrous metal against corrosion. Many allowying metals have been used in a zinc based hot-dip coating bath to improve the protective coating, and among the alloying metals which have been used are lead, tin, silicon, cadmium, antimony, magnesium and aluminum.

Among the patents which ahve been issued relating to hot-dip coating with zinc-aluminum alloys are U.S. Pat. Nos. 1,741,388; 1,764,132; 3,010,844; 3,148,080; 3,320,040; 3,343,930 and 3,505,043. Experiments have been conducted by immersing ferrous metal panels in a wide range of molten zinc-aluminum alloy baths, including immersing a panel for 24 hours in zinc-5% aluminum alloy bath (See *Edited Proceedings,* 6th International Conference on Hot-Dip Galvanizing, Interlaken, June 1971, pgs. 296–297, "The Effects of Agitation, Cooling and Aluminum On The Alloying In Hot-Dipping In Zinc" by Cameron et al). Zinc-aluminum alloys hve also been used for producing die castings, including 5% aluminum-zinc die casting alloys, but these alloys contain significant amounts of copper or other added alloying elements and impurities which are objectionable in a continuous hot-dip coating process (See *The Trans. Am. Inst. Met. Eng.* [1923] Vol. 68, 796 entitled "The Effect Of Impurities On The Oxidation and Swelling of Zinc Aluminum Alloys" by Brauer et al; and *Metallurgia,* August 1961, pgs. 57–66, "An Investigation Into Causes of Intercrystalline Corrosion in Zinc-Aluminum Alloys" by Roberts et al).

Despite the considerable efforts which have been made to provide an improved process for continuously hot-dip coating a ferrous metal strip with a zinc-aluminum alloy, there remains a need for improving the method by which hot-dip zinc-aluminum alloy coatings are continuously applied to a ferrous metal strip in order to obtain uniformly in a more economical manner a bright, smooth, attractively appearing, zinc-aluminum alloy hot-dip coated strip which has good corrosion resistance and is free of ripples and spangles which interferes with paintability and weldability.

One of the serious problems encountered when continuously hot-dip coating a ferrous metal strip, particularly with a zinc-aluminum alloy composition, is the formation of substantial amounts of a heavy, compact dross which accumulates in the coating bath and sinks to the bottom of the coating pot where it is difficult to remove (See U.S. Pat No. 3,320,040). It has heretofore been necessary periodically to shut down the continuous coating line to remove the heavy dross from the coating pot. Also, a further problem encountered in the prior methods of continuously applying zinc-aluminum alloy hot-dip coatings, particularly those containing substantial amounts of aluminum, has been the necessity of heating the zinc-aluminum alloy continuous hot-dip coating baths to a temperature substantially above the 850° F bath temperature generally used for conventional continuous hot-dip galvanizing. The increased bath temperature tends to impart undesirable properties to the zinc-aluminum alloy hot-dip coated product, such as causing the formation of an objectionally thick intermetallic layer which interferes with a good formability and imposes relatively narrow operating linits on he hot-dip coating process. Thus, heretofore it has been necessary to maintain the coating bath temperature, the strip immersion temperature and the strip immersion time within relative narrow operating limits in order to avoid producting an unsatisfactory zinc-aluminum continuous hot-dip coated product.

With the zinc-aluminum alloy continuous hot-dip coatings provided heretofore, the paintability of the hot-dip coating has been seriously impaired by the pesence of ripples, sag lines and large grained crystals or spangles which cause irregularities on the surface of the ferrous metal strip. Ripples, sag lines and large spangles in a hot-dip coating are clearly evident through the conventional paint or enamel finish coatings of the type which are normally aplied to building panels or automobile body panels. Also, the weldability of a coated product is unsatisfactory when the coating is not smooth. Temper rolling of the usual zinc-hot-dip coated products having ripples, sag lines and large grained crystals or spangles has heretofore been required in order to smooth out and remove the objectionable ripples and large spangled surface pattern. It is, therefore, considered highly desirable to minimize ripples, sag lines and spangle formation on hot-dip coatings to be painted, enameled or welded.

The size of the spangles which form in conventional continuous zinc-base hot-dip coatings tends to be large, because the convenional continuous hot-dip zinc coating bath temperature is relatively high and the period during which the hot-dip coating remains in the transition phase between liquidus and solidus tends to be prolonged wo that the solidification rate is relatively slow. The addition of certain metallic elements, such as lead, which are generally used to reduce surface ripples and improve the smoothness of the hot-dip coatings further increase the grain size or spangles. Thus, in the previous zinc-base continuous hot-dip coating processes, and particularly with zinc-aluminum alloy continuous hot-dip coating baths, the use of such additives as lead to control coating smoothness (i.e. minimize ripples) has been limited and cannot be used in an amount sufficient to insure a smooth zinc-aluminum continuous hot-dip coating without causing the formation of objectionably large spangles. And, when a metal such as magnesium is added to a zinc-aluminum alloy continuous hot-dip coating bath to improve corrosion resistance or minimize spangle formation, it becomes very difficult to produce continuously a smooth, non-rippled coating using conventional steam or other inexpensive oxygen containing blowing gas to cool or control the thickness of the allow coating. Furthermore, the addition of magnesium to a zinc-aluminum alloy coating bath results in the hot-dip coating losing its bright surface luster, and a dull coating does not have a satisfactory surface appearance for many commercial applications. The addition of copper to the zinc-aluminum alloy coating in amounts as little as 0.5 wt. percent imparts excessive brittleness to the coating and reduces formability below an acceptable level for sheet material.

It is therefore an object of the present invention to provide an improved and more economical zinc-aluminum alloy continuous hot-dip coated ferrous metal strip having good resistance against corrosion.

Another object of the present invention is to provide an improved zinc-aluminum alloy continuous hot-dip coated ferrous metal strip having an attractive bright, flat grained surface with minimal spangles and surface irregularities, such as ripples or sag lines which interfere with paintability and weldability.

Other objects of the present invention will be apparent to one skilled in the art from the following detailed description and claims.

The objectionable features of the prior zinc-aluminum alloy continuous hot-dip coated ferrous metal strips are overcome and an improved bright, smooth, paintable and weldable zinc-aluminum allow hot-dip coating which provides improved protection against corrosion is formed when the hot-dip coating bath consists essentially of the zinc-aluminum eutectic alloy having an aluminum content of substantially 5% by wt. with the balance being essentially zinc and containing as the only metallic additive a small amount of at least one metal which reduces the surface tension of the bath, such as lead, antimony and tin, in an amount not exceeding about 0.1 weight percent. The zinc-aluminum eutectic alloy when applied directly to the surface of a ferrous metal strip in accordance with the pesent invention present an adherent, bright, smooth, ripple-free, formable, weldable and paintable hot-dip coated strip which has a minimum spangle formation and which is highly resistant to a wide range of corrosive conditions, including resistance to a corroding salt environment, such as encountered on exposure to a marine atmosphere. And, unless the aluminum content is maintained within the narrow limits of 5.0 ± 0.5 wt. % and a said metallic additive present, the desired bright, smooth, paintable and weldable surface is not obtained.

When using the zinc-aluminum eutectic alloy for the hot-dip coating, an endless steel strip of the type which is suitable for conventional hot-dip galvanizing is first cleaned to remove surface contamination and oxides, as by means of a Sendzimir-type oxidation-reduction process. While the oxide free strip is at a temperature of between about 700° F and 1000° F, but preferably at about the temperature of the hot-dip coating bath or slightly above bath temperature, the stip is immersed in the zinc-aluminum eutectic alloy coating bath maintained at a temperature between about 750° F to about 850° F for a period ranging between about 5 seconds and 30 seconds. As the strip is withdrawn from the coating bath, the hot-dip coating preferably is cooled and simultaneously the thickness of the coating is controlled by impinging jets of gas onto the surface of the molten hot-dip coating. An oxidizing blowing gas, such as steam, air and carbon dioxide, or an inert gas, such as nitrogen, can be used to both cool and control the coating thickness. Steam at a temperature of 350° F–400° F has been particularly effecitve. Gas blowing apparatus which can be used in accordance with the present invention is described in such prior art patents as U.S. Pat. Nos. 3,406,656; 3,459,587; 3,449,418 and 3,667,425. The resulting zinc-aluminum eutectic alloy coating is metallurgically bonded to the surface of the steel by a thin intermetallic layer with good coating formability at ambient or room temperature.

An important and unexpected advantage of the present zinc-aluminum eutectic alloy continuous hot-dip coating process is the elimination of the heavy dross which normally collects at the bottom of a conventional hot-dip galvanizing bath and in previously known zinc-aluminum alloy coating baths. While the composition of the ternary dross and thus the density of the dross which is formed varies slightly above and below the density of the zinc-5% aluminum eutectic alloy bath, most of the dross formed under the operating conditions prevailing in the present continuous process has a density less than the density of the zinc-aluminum eutectic alloy. Thus, most of the ternary dross as formed floats on the surface of the zinc-aluminum eutectic bath. The small amount of dross having a density slightly heavier than the bath is oxidized as this dross is repeatedly brought to the surface by the pumping action of the strip moving through the continuous coating bath. As the metals in the heavier dross are oxidized, the density of the dross becomes less than the density of the zinc-aluminum eutectic coating bath and the dross remains on the surface of the bath. The relatively small amount of light iron-zinc-aluminum dross which collects on the surface of the eutectic coating bath can be readily removed by periodically top skimming of the coating bath without shutting down the continuous coating line.

The use of the zinc-aluminum eutectic alloy in a continuous hot-dip coating bath also makes it possible to achieve other important quality and operational improvements in a continuous hot-dip coating. For example, because the zinc-aluminum eutectic alloy has a melting point of about 720° F, as compared with a melting point of about 790° F for a conventional galvanizing bath containing about 0.2% by wt. aluminum, the continuous hot-dip coating bath in the present process can be kept at a temperature between about 750° F and about 850° f and preferably at a temperature of about 800° F and still provide the required fluidity without producing an excessive amount of intermetallic compound. The relatively low hot-dip coating bath temperature in the present process requires substantially less energy than in a conventional galvanizing process. And, since the rate of reaction between zinc and iron doubles with about every 18° F increase in the coating bath temperature, there is less iron contamination of the bath which can lower coating quality and less intermetallic compound is formed. Furthermore, with the present coating composition greater latitude is possible in controlling the hot-dip coating process which permits wider departure from the normal operating conditions without adversely affecting the hot-dip coating. For example, the time the strip can remain immersed in the zinc-aluminum eutectic alloy bath and the temperature of the stip at immersion can vary over a wider range than in previous zinc-aluminum continuous coating processes. And, contrary to what might be expected, using a hot-dip coating bath temperature below the temperatures normally used in conventional continuous galvanizing does not have an adverse effect on the adherence of the hot-dip zinc-aluminum eutectic alloy coating to the ferrous metal strip, and the zinc-aluminum eutectic alloy coating is metallurigically bonded to the surface of the steel by a thin intermetallic layer with good coating formability at ambient or room temperature.

While the continuous coating bath consisting of the high fluidity, low viscosity molten zinc-aluminum eutectic alloy of the present invention, the fused hot-dip coating on the metal stip levels out quickly and is transformed from the liquidus phase to the solidus pahse very soon after the coated strip is removed from the coating bath. Thus, the period during which exces intermetallic compound can form and crystals or spangles can grow is very short, and the formation of a smoother hot-dip coating with minimum spangles is facilitated. Nevertheless, even though the rate of phase transformation from liquidus to solidus is rapid when using the zinc-aluminum eutectic alloy, it has been found desirable to further increase the rate of transformation by external forced gas cooling of the hot-dip coating as it is withdrawn from the coating bath in order to avoid surface ripples and irregularities forming in the hot-dip coating. Furthermore, the presence of even a small fraction of one percent by wt. of magnesium in the zinc-aluminum hot-dip coating bath adversely affects the fluidity of the bath and greatly increases the difficulty of forming a smooth hot-dip coating, especially when an oxidizing blowing gas is used to control the coating thickness. The addition of magnesium also dulls the otherwise bright zinc-aluminum eutectic alloy hot-dip coating. Magnesium additions to the zinc-aluminum eutectic hot-dip continuous coating bath are, therefore, to be avoided.

It has also been found that the uniformity of the eutectic zinc-aluminum alloy continuous hot-dip coating on a steel strip can be improved by having the content of one or more metallic elements, such as lead, antimony and tin which are added to reduce surface ripples and improve the smoothness of the coating present at a level of about 0.1% by wt. Although lead, antimony and tin used in an amount of about 0.1% by wt. normally has the effect of increasing spangle size to the point where the surface appearance is undesirable and paintability or weldability impaired, because of the more rapid transformation of the zinc-aluminum eutectic alloy from the liquidus phase to the solidus phase, larger amounts of lead, antimony and tin can be tolerated in the zinc-aluminum eutectic alloy coating bath without causing objectionable spangle formation than is possible in conventional zinc coating baths and in other zinc-aluminum alloy continuous coating baths heretofore provided. It is, thus, possible with the process of the present invention to provide a smoother brighter appearing coating having only relatively small unobjectionable spangles, so that a paintable and weldable product is obtained without temper rolling.

A series of hot-dip coated ferrous metal strips embodying the present invention were formed on an experimental coating line which closely simulates a production heat-treat in-line continuous hot-dip zinc coating line, wherein strips of 20 gauge full hard steel about 6 inches wide having a chemical composition of about 0.1% carbon, 0.29% to 0.35% manganese, 0.01% to0.011% phosphorus, 0.019% to 0.020% sulfur and 0.04% copper with the balance being essentially iron were hot-dip coated with the zinc-aluminum eutectic alloy containing about 0.1% by wt. lead. Another like series was run with the zinc-aluminum eutectic bath containing about 0.1 wt.% antimony. The hot-dip coating baths were prepared by maintaining a quantity of pre-alloyed zinc-aluminum eutectic alloy in an induction heated refractory lined pot at a temperature of about 825° F to form a coating bath which contained 5% ± 0.5% by wt. aluminum with the balance comprising essentially zinc with a lead or antimony content of about 0.1% by weight. The steel strip to be coated was first passed continuously through a conventional alkaline chemical cleaning unit in which surface contaminants were removed, and thereafter the surface of the strip reduced in a hydrogen atmosphere to remove any surface oxides. In the alternative the strip can be cleaned by an oxidation-reduction process, generally in accordance with a conventional Sendzimir process.

The clean ferrous metal strip free of oxides and other metallic and non-metallic surface filsm or coatings at a strip immersion temperature of about 850° F was then continuously passed through the zinc-aluminum eutectic alloy coating bath maintained at a temperature of 825° F at a rate of about 30 to 60 ft. per minute with a dwell time in the bath contained in an induction heated ceramic lined pot between about 4 seconds and about 8 seconds. Steam at a temperature of 350° F was impinged upon the hot-dip coating as the strip was removed from the coating bath to control the thickness of the hot-dip coating to about 0.2 – 0.5 ounce per square foot for general coil coating. If culvert stock oil were desired, a coating weight of about 0.5 – 1.0 ounce per square foot would be required. The strip was air quenched and the hot-dip coating formed directly on the surface of the steel strip had a smooth bright appearance with only minimum spangles which did not interfere with good paintability.

During the continuous dot-dip coating process periodic bath additions of zinc-aluminum eutectic alloy were made as required to maintain the bath at the proper level. Top skimming formation was not excessive and appeared to be about the same as encountered in normal continuous hot-dip galvanizing line operations. No bottom dross was formed. The iron content of the coating bath did not increase significantly, and during a period extending over about five months, the iron analysis of the bath held constant at about 0.01% iron. Molten metal corrosion of the sinker roll arms extending into the hot-dip coating bath appeared negligible. Additional hot-dip coating runs were made in the above described manner at a bath temperature of 800° F with 22-gauge rimmed steel strips, some of which were differentially coated.

Accelerated corrosion tests on the above products have shown at least a 12 to 1 advantage in corrosion resistance over regular hot-dip galvanized steel. The results of the 5% salt fog test (ASTM B117 Test) showed that with the present eutectic alloy coating one could expect to obtain at least twice the exposure time from equal coating thicknesses or at least equal exposure time with one-half the coating thickness when compared with conventional hot-dip galvanized coatings. The results of the $S0_2$ cabinet exposure test [Kesternick (German) DIN50018] showed that a zinc-aluminum eutectic alloy hot-dip coating having approximately 40% of the coating thickness of a conventional hot-dip galvanized coating exhibited an improvement in corrosion resistance of approximately 1.5 to 2.0 times. Similar inprovements were found in outdoor exposure tests (ASTM G-1 Test) where the test panels were exposed to a marine type atmosphere. The corrosion rate (mils/year) was significantly lower for the zinc-aluminum eutectic alloy hot-dip coated product and the rate decreased as the exposure time increased in contrast with the higher and normal linear rate of corrosion for the conventional 0.2% aluminum, lead-free hot-dip galvanized control panels.

Spot weld tests carried out on the zinc-aluminum eutectic alloy hot-dip coated steel of the present invention showed satisfactory performance generally better than observed for conventional hot-dip galvanized steel for both the 20 and 22 gauge steel strips when coated on both surfaces with a 0.3 – 0.4 mils eutectic coating or when differentially coated with 0.5 on one side and 0.1 – 0.2 mils coating thicknesses on the opposite side and where the electrodes were in contact with the lighter side of the coating.

The formability of the zinc-aluminum eutectic alloy hot-dip coating which is one of the essential properties of a useful hot-dip coated strip was equal or superior to that of conventional hot-dip galvanized coatings and successfully passed The Olsen Button Draw Test, the Reverse Impact Test, the 180° Bend Test and the Lock Seam Test.

The zinc-aluminum eutectic alloy hot-dip coated surface, after the application of a conventional zinc phosphate pretreatment, exhibited satisfactory paintability on application of conventional enamel coatings of the type used on automobile body panels. No flaking was observed on the cross-hatch adhesion test (Adaptation of ASTM D2197 Test). Test results using a coil coating paint system show that the zinc-aluminum eutectic alloy hot-dip coating is at least equal to conventional hot-dip galvanized steel.

We claim:

1. A corrosion resistant continuous hot-dip coated ferrous metal strip having applied directly on a surface thereof a hot-dip coating consisting essentially of:

1. zinc-aluminum eutectic alloy which contains 5.0 ± 0.5 wt. % aluminum, and
2. at least one metallic additive effective for lowering the surface tension of the coating selected from the group of metals consisting of lead, antimony, and tin with the total amount of said mtallic additives present in said coating being a maximum of about 0.1 wt. %, with the balance essentially zinc;

and said coating being characterized by a bright, smooth surface which is free of both ripples and spangles which interfere with the paintability and weldability of the strip and said coated strip being formable and resistant to corrosion due to exposure to a marine-type environment.

2. A corrosion resistant continuous hot-dip coated ferrous metal strip as in claim 1, wherein said coating contains a total of about 0.1 wt. % of the said metallic additives.

3. A corrosion resistant continuous hot-dip coating as in claim 2, wherein the said metallic additive is lead.

4. A corrosion resistant continuous hot-dip coating as in claim 2, wherein the said metallic additive is antimony.

* * * * *

UNITED STATES PATENT AND TRADEMARK OFFICE

CERTIFICATE OF CORRECTION

PATENT NO. : 4,056,657

DATED : November 1, 1977

INVENTOR(S) : Leckie, Sievert and Legault

It is certified that error appears in the above-identified patent and that said Letters Patent are hereby corrected as shown below:

Col. 1, line 8, "allow" should read --alloy--.
Col. 2, lines 7-8, "linits on he" should read --limits on the--.
Col. 2, line 12, "producting" should read --producing--.
Col. 2, line 40, "prolonged wo" should read --prolonged so--.
Col. 2, line 59, "allow" should read --alloy--.
Col. 3, line 17, "allow" should read --alloy--.
Col. 3, line 47, "stip" should read --strip--.
Col. 4, line 67, "stip" should read --strip--.
Col. 4, line 68, "pahse" should read--phase--.
Col. 5, line 2, "exces" should read --excess--.
Col. 6, line 7, "filsm" should read --films--.
Col. 6, line 42 "12 to 1" should read --2 to 1--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*